US005970277A

United States Patent [19]

Shigeta et al.

[11] Patent Number: 5,970,277

[45] Date of Patent: Oct. 19, 1999

[54] IMAGE FORMING APPARATUS

[75] Inventors: Kunio Shigeta; Yotaro Sato; Satoshi Haneda; Hisayoshi Nagase, all of Hachioji, Japan

[73] Assignee: Konica Corporation, Japan

[21] Appl. No.: 09/248,081

[22] Filed: Feb. 10, 1999

[30] Foreign Application Priority Data

Feb. 16, 1998 [JP] Japan ..... 10-032813

[51] Int. Cl.[6] ..... G03G 15/00

[52] U.S. Cl. ..... 399/45; 399/306; 399/309

[58] Field of Search ..... 399/38, 45, 50, 399/297, 306, 308, 309, 315, 316, 397, 399, 400

[56] References Cited

U.S. PATENT DOCUMENTS

| | | | |
|---|---|---|---|
| 4,427,285 | 1/1984 | Stange | 399/306 |
| 4,688,925 | 8/1987 | Randall | 399/309 |
| 4,941,021 | 7/1990 | Uchida et al. | 399/45 X |
| 4,958,187 | 9/1990 | Tsuchiya et al. | 399/306 |
| 5,585,908 | 12/1996 | Rakov et al. | 399/45 X |
| 5,655,176 | 8/1997 | Inoue et al. | 399/45 |
| 5,826,143 | 10/1998 | Haneda et al. | 399/45 X |
| 5,848,323 | 12/1998 | Umeda et al. | 399/306 X |

*Primary Examiner*—Sandra Brase

*Attorney, Agent, or Firm*—Jordan B. Bierman; Bierman, Muserlian and Lucas

[57] ABSTRACT

The present invention relates to an image forming apparatus which forms images on both surfaces of a sheet-shaped medium using the electrophotographic method. There is described a double-sided image forming apparatus, which includes a first and a second image bearing elements to bear toner images, a first and a second transfer units for transferring the toner images to the sheet-shaped medium from the first and the second image bearing elements, a fixing unit for fixing the toner images transferred to the sheet-shaped medium, a discharger to discharge electric charges residing on the sheet-shaped medium, a detector to detect thickness and/or stiffness data of the sheet-shaped medium, and a controller to control a first image forming mode which enables to form images on both surfaces of the sheet-shaped medium, and to control a second image forming mode which enables to form an image on only a single surface of the sheet-shaped medium.

13 Claims, 4 Drawing Sheets

FIG. 3 ( A )
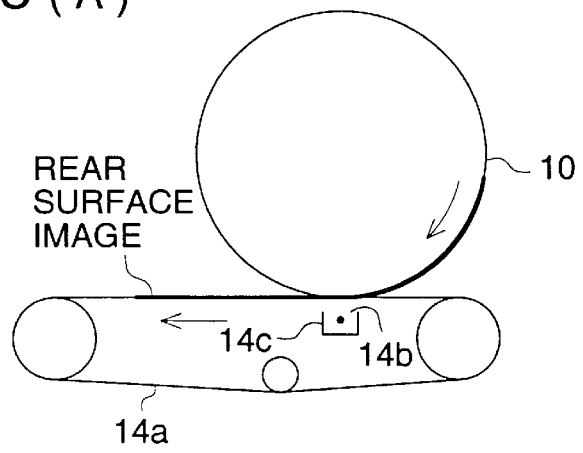
FIG. 3 ( B )
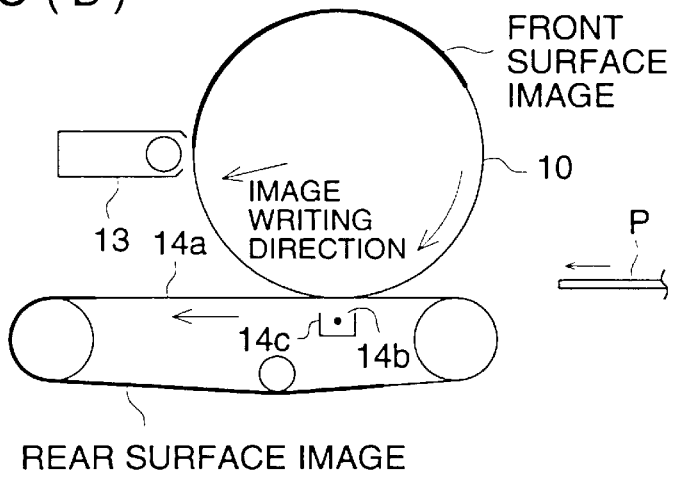
FIG. 3 ( C )
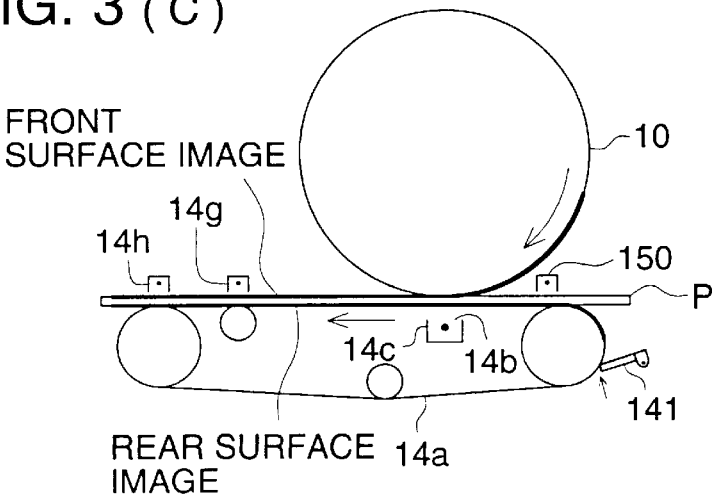

IMAGE FORMING APPARATUS

BACKGROUND OF THE INVENTION

The present invention relates to an image forming apparatus which performs double-sided image formation on a sheet-shaped medium using the electrophotographic method, such as in a copier, a printer, a facsimile, etc., wherein toner images formed on an image bearing element are transferred and fixed onto both surfaces of the sheet-shaped medium after processing of the charging means, the exposing means and the developing means which are arranged around the periphery of the image bearing element.

Heretofore, in duplex copying, employed has been a method in which the first image formed on the image bearing element is transferred and fixed onto the sheet-shaped medium, and then this material is temporarily stored in a reverse paper feeding device for duplex copying, wherefrom it is conveyed out, synchronized with the formation of the second image on the image bearing element, so that the second image is transferred and fixed onto the other side of the sheet-shaped medium.

In the abovementioned duplex copying apparatus, since the transportation of the sheet-shaped medium is carried out twice in such a manner as to feed it to the reverse paper feeding device and to again pass it through the fixing apparatus, the reliability of the transportation is decreased, resulting in unacceptably frequent jam occurrences. To cope with this problem, there has been proposed an apparatus which fixes toner images transferred on both surfaces of the sheet-shaped medium all at once, after transferring operation, set forth in Tokkoushou 49-37535, 54-28740, Tokkaihei 1-44457, 4-21576, etc. Especially, Tokkaihei 1-44457, 4-21576, etc. have disclosed a method for forming a duplex copy with color images by means of a plurality of image forming means comprising a image bearing element, a charging means, an image exposing means and a developing means, which are arranged in parallel to a toner image receiving member.

The applicants of the present invention has been studying a duplex image forming method wherein a toner image formed on an image bearing element (a first image bearing means) is temporarily transferred onto an intermediate transfer element (a second image bearing means) one at a time, and, after another toner image is formed again on the first image bearing element, both toner images are transferred simultaneously onto both surfaces of the sheet-shaped medium. There have been problems, however, in the difficulty of the sheet-shaped medium separating from the image bearing elements which caused transportation defects and/or deformation of the sheet-shaped medium, causing a scattering of toner on the unfixed transferred image.

SUMMARY OF THE INVENTION

As a result of the solution and improvement of the above-mentioned problem, it is an objective of this invention to provide an duplex image forming apparatus which produces high quality fixed images by selecting a separating means in accordance with the thickness and/or quality of sheet-shaped mediums, and is capable of reliably separating the sheet-shaped medium with transferred images and conveying it to a fixing means by restricting the image formation modes.

The above-mentioned objectives are accomplished by a double-sided image forming apparatus, which forms images on both surfaces of a sheet-shaped medium, comprising:

a first image bearing element to bear a toner image;

a second image bearing element, mounted opposite the first image bearing element, to bear a toner image;

a first transfer means for transferring the toner image to a first surface of the sheet-shaped medium from the first image bearing element;

a second transfer means for transferring the toner image to a second surface of the sheet-shaped medium from the second image bearing element;

a fixing means for fixing the toner images transferred to the sheet-shaped medium, wherein the sheet-shaped medium is conveyed to the fixing means by the second image bearing element, after the first transfer means transfers the toner image to the first surface of the sheet-shaped medium, and the second image bearing element includes a separating section with a curved shape, located at an end portion of it toward the fixing means, to separate the sheet-shaped medium from the second image bearing element by means of a curvature of the separating section;

a discharger, disposed opposite to the second image bearing element, to discharge electric charges residing on the sheet-shaped medium, after the toner image is transferred onto the second surface of the sheet-shaped medium;

a detector to detect thickness and/or stiffness data of the sheet-shaped medium; and a controller to control a first image forming mode, which enables to form images on both surfaces of the sheet-shaped medium by means of both the first image bearing element and the second image bearing element, and to control a second image forming mode, which enables to form an image on only a single surface of the sheet-shaped medium by means of the first image bearing element, wherein the controller controls the discharging operation of the discharger, the first image forming mode and the second image forming mode, on the basis of the data detected by the detector.

BRIEF DESCRIPTION OF THE DRAWINGS

Other objectives and advantages of the present invention will become apparent upon reading the following detailed description and upon reference to the drawings in which:

FIGS. 3(*a*) to 3(*c*) are explanatory illustrations showing image transferring processes;

DETAILED DESCRIPTION OF THE PREFERRED EMBODIMENT

An embodiment of the present invention will now be detailed. The following decisive description neither confine the scope of the present invention nor the technical terminology, but merely expresses the best mode of the present invention. In the following description, the surface of the sheet-shaped medium, opposite the first image bearing means at the transfer region, and the other side of the surface, namely, the surface opposite the second image bearing means, are defined as the front surface and the rear surface, respectively. In addition, an image transferred to the front surface of the sheet-shaped medium and an image transferred to the other side of the sheet-shaped medium are defined as the front surface image and the rear surface image respectively.

Figure 1:
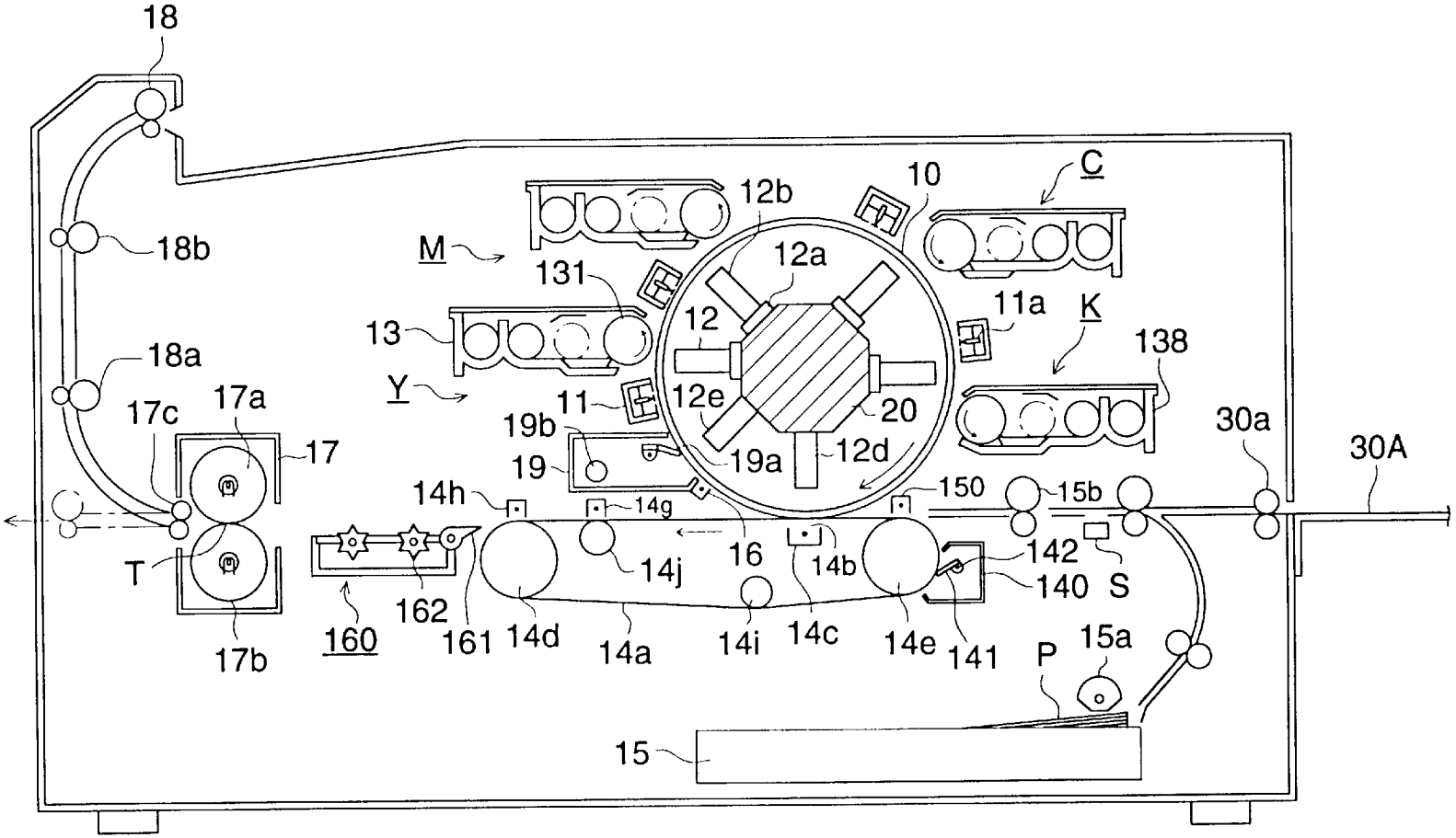
FIG. 1 is a cross-sectional view showing the construction of an image forming apparatus to which this invention applies.
Figure 2:
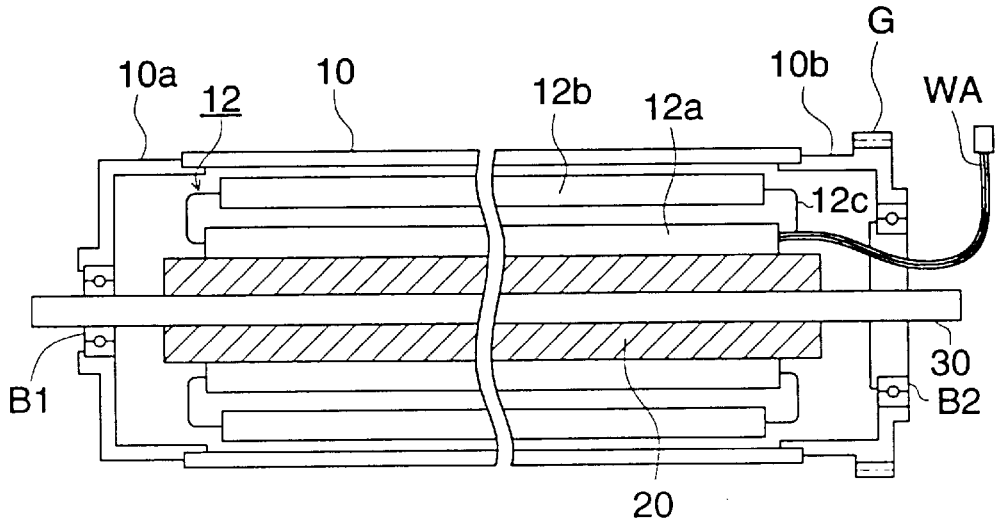
FIG. 2 is the side cross-sectional view of the photoreceptor drum 10.

With reference to FIG. 1 through FIG. 3, the image forming process and every mechanism of this embodiment of the image forming apparatus according to this invention will be explained. FIG. 1 is a cross-sectional view of the structure of the color image forming apparatus showing an embodiment of this invention, FIG. 2 is a side cross-sectional view showing the image bearing means in FIG. 1, and FIG. 3 shows how the toner images of both surfaces relating to this embodiment are formed. Specifically, FIG. 3(A) shows a step of forming the rear surface image by transferring the toner image formed on the first image bearing means to the second image bearing means. FIG. 3(B) shows a step of forming the front surface image, synchronized with the rear surface image on the second image bearing means. FIG. 3(B) shows a step of forming the duplex image on both surfaces of the sheet-shaped medium.

The photoreceptor drum 10, as the first image bearing means, is provided with a cylindrical substrate made of a transparent material such as an optical glass or a transparent acrylic resin, and comprises a transparent conductive layer and a photosensitive layer formed on the outer periphery of said substrate, which is rotated clockwise as shown by the arrow in FIG. 1, while the conductive layer is electrically grounded.

As shown in FIG. 2, the photoreceptor drum 10, with the flange members 10*a* and 10*b*, engaged at both end surfaces for fixing the drum supported to able it to rotate on the drum shaft 30, which is mounted and fixed to the apparatus mainframe by the bearing members B1 and B2, which are inserted in said flange members at both ends of the drum, is rotated at a constant speed in the predetermined direction by the driving gear G, formed integrally on the flange member 10*b*, engaging with the driving gear (not shown) in the apparatus mainframe. The lead wire WA is connected to the light emitting element (LED) of the image writing means, to be described later.

In the present embodiment, four sets of an image forming unit utilized for forming four color images, such as yellow (Y), magenta (M), cyan (C), and black (K), are arranged in order of Y, M, C, K toward the rotating direction of the photoreceptor drum 10 as shown by the arrow in FIG. 1, wherein each set of the image forming unit for every color comprises a scorotron charger 11 as a charging means, an optical exposure unit 12 as an image writing means and a developing unit 13 as a developing means.

Each of the four scorotron chargers 11, as a charging means for every color, comprises a control grid kept at a specified electric potential and a discharging electrode 11*a* made up of, e.g., a sawtooth electrode, which are mounted opposite to the aforesaid photosensitive layer of the photoreceptor drum 10, and carry out the charging process (negative charging in this embodiment) by corona discharging at the same polarity as the toner to impress a uniform electric potential to the photoreceptor drum 10. As for the discharging electrode 11*a,* other electrode types, such as a wire electrode, can be employed.

The optical exposure units 12, as the image writing means for each of the four color, is mounted in inside the photoreceptor drum 10 at such a place that the exposure position on the photoreceptor drum 10 is located downstream of the photoreceptor drum 10 with respect to the position of each respective scorotron charger 11. As shown in FIG. 2, each of the optical exposure units 12 is mounted on a holding member 12*a* 20, and is composed of: a linear light emitting element 12*a* having an array of a plurality of LEDs (light emitting diodes) as the light emitting elements arranged in the main scanning direction, being parallel to the shaft axis 30 of the photoreceptor drum 10; a light converging transmission device 12*b* (commercial name: SELFOC Array Lens) as a focusing element with magnification to the same size; and a lens holder 12*c* to which said SELFOC Array lens is fitted. In addition to the optical exposure units 12 for each of the respective colors, the uniform exposure device 12*e*, and the simultaneous transfer exposure device 12*d* are fitted to the holding member 20 which is mounted beneath the enclosing substrate of the photoreceptor drum 10. Each of the optical exposure units 12, for each of the four colors, forms a latent image on the photoreceptor drum 10 by exposing images from the rear surface of the photoreceptor drum 10 in accordance with image data of each of the four colors, which have been read by an image reading apparatus, housed separately, and stored in a memory means. Employed as the light emitting element 12*a*, can be an FL (fluorescent luminescence), an EL (electro-luminescence), and a PL (plasma luminescence) having a plurality of light emitting elements arranged in an array. In regard to the wavelength of the light emitting element 12*a* for image exposing, ones in the range of 680–900 nm, to which the toners for Y, M, and C are highly transparent, are usually employed, but a light with a shorter wavelength than the above-mentioned in the range of 400–780 nm, to which color toners have not sufficient transparency, may be used because the exposure is made from the inside (rear surface) of the photoreceptor drum 10 in this embodiment.

The developing units 13, as the developing means for the respective colors, are provided with the developing sleeve 131 which is positioned at a specified spacing to the peripheral surface of the photoreceptor drum 10 and rotates in such a manner that both surfaces move in the same direction at the developing position. the developing sleeves 131 are made up of a cylinder having, e.g., a thickness of 0.5–1 mm and an outer diameter of 15–25 mm, formed of a non-magnetic stainless steel or an aluminum material, and also are provided with developer casings, each of which stores single- or two-component developer of the color, such as yellow (Y), magenta (M), cyan (C), or black (K). Each of the developing units 13 is kept in a position of non-contact with the photoreceptor drum 10 at a predetermined spacing for development of, e.g., 100–500 $\mu$m by a rolling spacer (not shown). At the time of the developing operation, a development bias voltage, composed of a direct current voltage and an alternate current voltage, is applied to the developing sleeve 131 to form a toner image on the photoreceptor drum 10 by carrying out a non-contacting reverse development.

The toner image receiving member 14*a*, as the second image bearing element, is a seamless belt having a volume resistivity of $10^8$–$10^{12}$ Ωcm, or of $10^{12}$–$10^{15}$ Ωcm as a more desirable range, and having a double layer structure in which a 5–50 $\mu$m toner filming preventing layer of a fluorine is coated on the outer surface of a 0.1–1.0 mm semi-conductive film substrate, which is made of an engineering plastic such as, e.g., a modified polyimide, a thermosetting polyimide, an ethylenetetraflouoroethylene copolymer, a polyfluorovinilidene, a nylon alloy, etc. dispersed with conductive materials, as a desirable example. For the belt substrate, it is also possible to employ a 0.1–1.0 mm semi-conductive rubber belt, made of a silicon rubber or an urethane rubber dispersed with conductive materials.

The toner image receiving member 14*a* is inscribed by and threaded on the driving roller 14*d*, the rotating roller 14*e* and the tension roller 14*i*, to be rotated counterclockwise as designated by the arrow in FIG. 1. The mounting order of the rotating roller 14*e*, the guiding roller 14*j*, the driving roller 14*d* and the tension roller 14*i* is arranged in accordance with the rotating direction of the toner image receiving member 14*a*. Although the rotating roller 14*e*, the guiding roller 14*j* and the driving roller 14*d* rotate at fixed positions, the tension roller 14*i* is flexible and movable in response to the elastic force of the toner image receiving member 14*a* while it is rotating. Thus, the rotation of the toner image receiving member 14*a* is driven by the driving roller 14*d* engaged with a driving motor, and the rotation of the guiding roller 14*j*, the rotating roller 14*e* and the tension roller 14*i* are due to the rotation of the toner image receiving member 14*a*. The slack of the toner image receiving member 14*a* while rotating is tautened by means of the tension roller 14*i*. The toner image receiving member 14*a* absorbs a sheet-shaped medium on its surface, which is charged by a charging means for the sheet-shaped medium, as described later, and conveys it to the edge portion toward a fixing means, as described later. The driving roller 14*d* forms a curvature on the toner image receiving member 14*a* at its end portion toward the fixing means which separates the sheet-shaped medium from its surface by means of the curvature. It is recommended that the radius of the driving roller 14*d*, which forms the curvature, not greater than 15 mm, or not be greater than 10, as a more desirable value.

The transfer means 14*c*, serving as both the first and second transfer means, is located opposite the photoreceptor drum 10, inserting the toner image receiving member 14*a*, to form a transfer region 14*b* between the photoreceptor drum 10 and the toner image receiving member 14*a*. A direct current voltage with a polarity opposite of the toner (in this embodiment, a plus polarity) is applied to the transfer means 14*c* to transfer the toner image on the photoreceptor drum 10 to the surface of the toner image receiving member 14*a*, or the front surface of the sheet-shaped medium, by forming a transfer electric field in the transfer region 14*b*.

A rear surface transfer means 14*g*, as the third transfer means, is located opposite the conductive guiding roller 14*j*, inserting the toner image receiving member 14*a*, to transfer the toner image on the toner image receiving member 14*a* to the rear surface of the sheet-shaped medium, by applying a direct current voltage with a polarity opposite to the toner (in this embodiment, a plus polarity).

A paper charger 150, as the charging means for the sheet-shaped medium, is located opposite the grounded rotating roller 14*e*, inserting the toner image receiving member 14*a*, to attract the incoming sheet-shaped medium to the toner image receiving member 14*a*.

A paper separating AC discharger 14*h*, as the separating means for the sheet-shaped medium, is a corona discharger, which is located opposite conductive and grounded driving roller 14*d* at the end portion toward the fixing unit 17, to discharge the sheet-shaped medium, conveyed by the toner image receiving member 14*a*, by applying an alternative current voltage biased with a direct current voltage having a opposite or a same polarity depending on the sort of the sheet-shaped medium.

A conveyance unit 160 is located midway between the toner image receiving member 14*a* and the fixing unit 17, while a separating claw 161 and spur wheels 162 are mounted on the upper portion of the conveyance unit 160. When the sheet-shaped medium is separated from the toner image receiving member 14*a*, a separating claw 161 and spur wheels 162 scoop up the sheet-shaped medium which tends to be conveyed along the curvature of, while conveying the sheet-shaped medium, having the toner image on rear surface, to the fixing unit 17 without disturbing of the toner image on the toner image receiving member 14*a*.

The fixing unit 17, as the fixing means, comprises a pair of rollers, one of which is a fixing roller 17*a*, as the upper side (front surface) fixing member, and the other is a pressing roller 17*b*, as the lower side (rear surface) fixing member, which fix the toner image on the sheet-shaped medium by applying heat and pressure to it between the fixing roller 17*a* and the pressing roller 17*b*.

Next, the image forming processing will be described in the following.

When image recording commences, the photoreceptor drum 10 is rotated clockwise, designated by the arrow shown in FIG. 1, by means of the driving motor (not shown) for the photoreceptor drum 10. Simultaneously, the charging process to give a potential to the photoreceptor drum 10 is started by the charging operation of the scorotron charger 11 for yellow (Y).

After applying the electrical potential to the photoreceptor drum 10, the image writing by the first color signal, namely, the electric signal corresponding to the image data for Y, is started in the optical exposure unit 12 for Y, to form a latent electrostatic image on the surface of the photoreceptor drum 10, corresponding to the image for Y portion of the original document image.

With the rotation of the photoreceptor drum 10, the above-mentioned latent image is reversely developed by the developing unit 13 for Y in the non-contact state to form the toner image of yellow (Y).

Next, the electric potential, superposed on the toner image of yellow (Y), is applied to the photoreceptor drum 10 by the charging operation of the scorotron charger 11 for magenta (M), and is subjected to the image writing in the optical exposure unit 12 for M by the second color signal, namely, the electrical signal corresponding to the image data for M, to form the toner image of magenta (M) superposed on the aforesaid toner image of yellow (Y) by non-contact reverse development of the developing unit 13 for M.

Through the same process as mentioned above, the toner image of cyan (C) corresponding to the third color signal is superposed on the previous toner images by means of the scorotron charger 11 for cyan (C), the optical exposure unit 12 for C and the developing unit 13 for C. Further, the toner image of black (K) corresponding to the fourth color signal, is sequentially superposed on the previous toner images by means of the scorotron charger 11 for black (K), the optical exposure unit 12 for K and the developing unit 13 for K. As a result, a full color toner image superposed by the four colors of yellow (Y), magenta (M), cyan (C) and black (K) is formed on the peripheral surface of the photoreceptor drum 10 within one rotation of it.

The image writing on the photosensitive layer of the photoreceptor drum 10 by these optical exposure units 12 for Y, M, C, and K is carried out from the inside of the drum through the aforesaid transparent substrate. Accordingly, any one of the image writing operation corresponding to the second, third, or fourth color signals is carried out without being influenced by the previously formed toner images at all; hence, it is possible to form each latent electrostatic image having a quality equivalent to the image formed by the first color signal.

The superposed full color toner image, formed on the photoreceptor drum 10, as the first image bearing element, through the above-mentioned image forming process, is transferred all at once at the transfer region 14*b* onto the toner image receiving member 14*a*, as the second image bearing element, by means of the transfer means 14*c* (FIG. 3(A)). At this time, a uniform exposure by the simultaneous transfer exposure unit 12*d*, mounted inside the photoreceptor drum 10, is carried out, in order to insure good transferring results.

After the transferring operation, any toner particles remaining on the peripheral surface of the photoreceptor drum 10 are discharged by means of an AC discharging unit 16 for the photoreceptor drum 10, and then approach to the cleaning unit 19, as a cleaning means for the photoreceptor drum 10, where they are scraped off the photoreceptor drum 10 by the cleaning blade 19*a*, made of a rubber material engaging with the photoreceptor drum 10, and are conveyed to a spent toner container (not shown) by means of an Archimedean screw 19 *b*. Further, in order to eliminate the image hysteresis previously formed on the photoreceptor drum 10, a discharging operation on the peripheral surface of the photosensitive drum 10 is carried out by exposing a light with the pre-charging uniform exposure unit 12*e* which employs, e.g., a light emitting diode.

After the superposed color toner image for the rear surface is formed on the toner image receiving member 14*a* through the abovementioned processes, a superposed full color toner image of the front surface is continuously formed on the photoreceptor drum 10 through the same color image forming processes as mentioned above (FIG. 3(B)). At this time, the image data of the front surface image to be formed on the photoreceptor drum 10, should be modified so that the front surface image is converted into a mirror image with respect to the rear surface image already formed on the photoreceptor drum 10.

With the image formation for the front surface on the photoreceptor drum 10, a recording paper P, as the sheet-shaped medium, is conveyed from a paper feeding cassette 15, as the sheet-shaped medium receiving means, by a convey-out roller 15*a*. The recording paper P is further conveyed to the timing roller 15*b*, as the sheet-shaped medium conveyance means, to feed it to the transfer region 14*b* by means of the timing roller 15*b*, while synchronizing the movement of the color toner image of the front surface, formed on the photoreceptor drum 10, with that of the rear surface, formed on the toner image receiving member 14*a*. At this time, the recording paper P is charged at the same polarity as the toner by means of the paper charger 150, to which a direct current voltage with the same polarity as the toner (in this embodiment, a minus polarity) is applied and the recording paper P is contacted. Then, the recording paper P is conveyed to the transfer region 14*b* by attracting it on the toner image receiving member 14*a*. Charging the paper at the same polarity as the toner prevents the paper from attracting the toner image onto the toner image receiving member 14*a* or onto the photoreceptor drum 10, so that the toner image is prevented from being disturbed. The voltage is applied to the paper charger 150 only while the recording paper P is passing by it, and hence the voltage applied to the paper charger 150 is cut off immediately after the recording paper P passes.

In the transfer region 14*b*, the toner image on the photoreceptor drum 10 for the front surface is transferred all at once onto the front surface of the recording paper P by the transfer unit 14*c*, as the second transfer means, to which a voltage at the reverse polarity to the toner (in this embodiment, a plus polarity) is applied. At this time, the toner image for the rear surface, formed on the toner image receiving member 14*a*, is not transferred to the recording paper P, but remains on the toner image receiving member 14*a*. At the time of the transferring action by means of the transfer unit 14*c*, it is recommended that a uniform exposure is applied to the transfer region 14*b* by means of the simultaneous transfer exposure device 12*d* which employs, e.g., a light emitting diode and is mounted opposite the transfer region 14*b* inside the photoreceptor drum 10, in order to insure good transferring.

The recording paper P with a full color toner image on its front surface is conveyed to the rear surface transfer means 14*g*, as the third transfer means, to which a voltage is applied at a reverse polarity to the toner (in this embodiment, a plus polarity) . Then, the rear surface image, formed on the toner image receiving member 14*a*, is transferred all at once onto the rear surface of the recording paper P by the rear surface transfer means 14*g* (FIG. 3(*c*)).

Next, the recording paper P is separated from the toner image receiving member 14*a* at the curvature of the driving roller 14*d* which drives the toner image receiving member 14*a*, and by the discharging operation of the paper separating AC discharger 14*h*, as the sheet-shaped medium separating means, to which a voltage is applied in accordance with the sort of the sheet-shaped medium, and which is mounted opposite the driving roller 14*d* at the curved end portion of the toner image receiving member 14*a*. Then, the recording paper P is further conveyed to the fixing unit 17, serving as the fixing means, by means of the conveyance unit 160 equipped with the separating claw 161 and the spur wheels 162.

The recording paper P, having full color toner images formed on both surfaces of it, is further conveyed to the fixing unit 17, serving as the fixing means, comprised of a pair of heated upper and lower rollers 17*a* and 17*b*. In the fixing unit 17, the toner images on both surfaces of the recording paper P are fixed by applying heat and pressure at the nipping area T, which is formed between a lower pressure roller 17*b* for fixing the rear surface image (the lower side image) and an upper fixing roller 17*a* for fixing the front surface image (the upper side image). The recording paper P, with fixed images on both surfaces, is finally delivered to the upper portion of the apparatus by inverting and conveying it between the fixed paper delivering rollers 17*c*, the paired conveyance rollers 18*a* and 18*b*, and the paired delivering rollers 18, in such a manner that the toner image of the front surface faces down. It is also possible to deliver the recording paper P, so that the toner image of the front surface faces up, by changing the delivering path utilizing a switching member (not shown), which can be mounted at the rear of the fixed paper delivering rollers 17*c* located at the outlet of the fixing unit 17.

Any toner particles remaining on the peripheral surface of the toner receiving member 14*a* are cleaned off the toner receiving member 14*a* by means of the cleaning unit 140, in which the cleaning blade 141 is mounted on the supporting shaft 142 in such a manner that it is capable of contacting and withdrawing from the toner receiving member 14*a* by pivoting on the supporting shaft 142.

On the other hand, any toner particles remaining on the peripheral surface of the photoreceptor drum 10, namely, the residual toner, are scraped off by means of the cleaning unit 19, after being discharged by means of the AC discharging unit 16. Thereby, any hysteresis of previous image formation remaining on the photoreceptor drum 10 is eliminated by means of the pre-charging uniform exposure unit 12*e*, in preparation for the next cycle of the image formation.

In order to supply, e.g., either a relatively thick or a relatively thin recording paper P, which is difficult to supply from the paper feeding cassette 15, the abovementioned double-sided image forming apparatus further comprises a manual paper feeding plate 30A which is located on the side of the main frame and makes it possible to directly feed the recording paper P to the timing roller 15*b* by activating the manual feeding rollers 30*a*, instead of the convey-out roller 15*a*, by effecting a paper feeding mode change.

Further, the abovementioned double-sided image forming apparatus also comprises a recording paper sensor S, which is located upstream of and near the timing roller 15*b*, to detect the material quality, thickness, etc. of the recording paper P, fed from either the paper feeding cassette 15 or the manual paper feeding plate 30A, by means of an electric capacity and/or a paper thickness detecting means.

Figure 4:
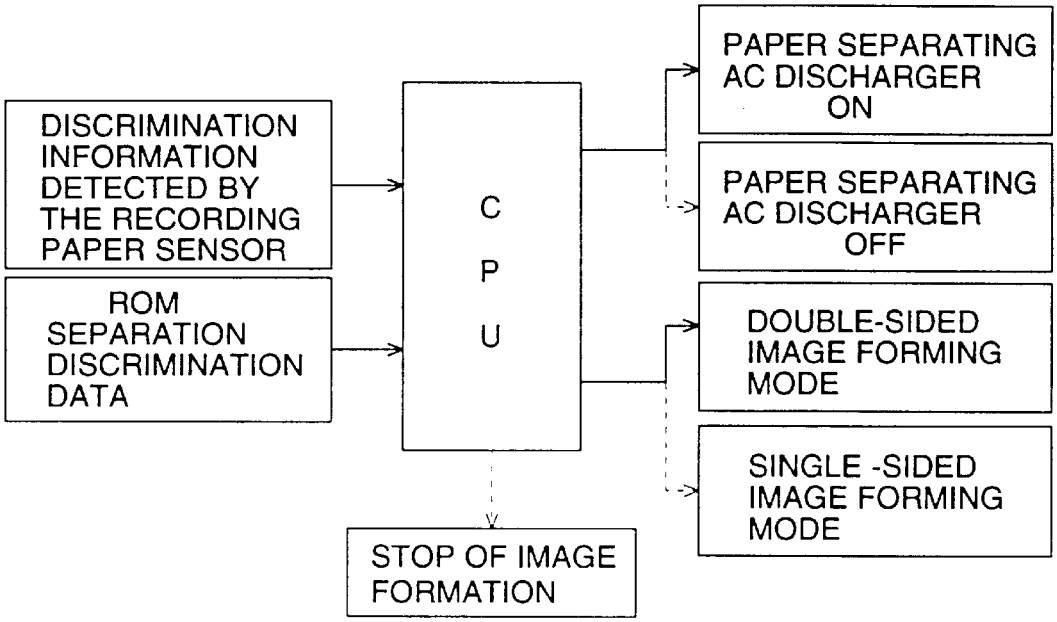
FIG. 4 is a block diagram showing the control system of the apparatus.

In the control section, the control circuit, as shown in FIG. 4, receives detected data from the recording paper sensor S and compares it with the image forming mode, the discrimination data and the separation discrimination data, which are previously stored in the ROM and are retrieved from the ROM, to determine whether a specific image forming mode should be selected, either double-sided or single-sided, and to also control the discharging conditions of the paper separating AC discharger 14*h*, on the basis of the comparison results.

When the control section determines, on the basis of the detected results of the recording paper sensor S, that the thickness and the stiffness of the recording paper P slightly exceeds the predetermined range, namely, it is within a possible range to separate smoothly from the toner receiving member 14*a* without a separating action by means of the paper separating AC discharger 14*h* and to transfer images on both surfaces (for example, when the recording paper P having 60–200 g/m2 is utilized), the control section stops the discharge from the paper separating AC discharger 14*h*, and the recording paper P having transferred toner images on both surfaces is separated from the surface of the toner receiving member 14*a* by the curvature of the driving roller 14*d* and/or the exfoliating action of the separating claw 161.

Figure 5:
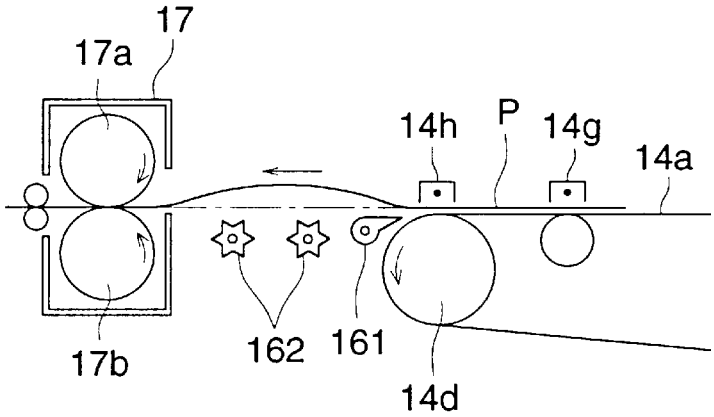
FIG. 5 is an explanatory illustration showing separation and conveyance of the sheet-shaped medium.

Initially, the separated recording paper P is conveyed substantially in the horizontal direction, as shown by a chain line in FIG. 5. After contacting the fixing rollers, in order to promote a separating action, it is puckered upward, forming a loop, by a slight difference of rotation rate between the toner image receiving member 14*a* and each of the fixing rollers 18*a*, 18*b* (the line velocity of the toner image receiving member 14*a* is slightly higher than that of the fixing rollers). Although the recording paper P receives a some amount of force in reverse to the conveyance direction at that time, the scattering of the toner image on the rear surface is prevented, since close adherence between the recording paper P and the toner image receiving member 14*a* is maintained by stopping the discharging action.

When the discharge operation of the paper separating AC discharger 14*h* is performed under such a condition that the recording paper P is separated from the toner image receiving member 14*a* without the separating action of the paper separating AC discharger 14*h*, the toner image on the rear surface would be scattered due to a slippage between the recording paper P and the toner image receiving member 14*a*.

When the control section determines that the thickness and the stiffness of the recording paper P greatly exceeds the predetermined range, so that it is likely too difficult to form the abovementioned loop with the probability of being pushed back after contacting the fixing rollers (for example, when the recording paper P in a range of 200 g/m2–300 g/m2 is utilized), the control section changes the double-sided image forming mode to the single-sided image forming mode to perform a front surface image formation only. In addition, the discharging operation of the paper separating AC discharger 14*h* is accordingly maintained in an arrested status.

In the case mentioned above, it is intended to prohibit the double-sided image formation, since a good image quality on the rear surface would not likely be obtained due to poor transferability of toner image onto the rear surface of the recording paper P, even if an image formation of rear surface is attempted.

When the control section determines that the thickness and the stiffness of the recording paper P further greatly exceeds the predetermined range, so that it is again difficult to adequately perform the transferring and fixing operations of the front surface image (for example, when the recording paper P having more than 300 g/m2 is utilized), the image formation is banned as a whole, displaying "copy impossible" on the display section located on the operating panel.

When the control section determines, on the basis of the detected results of the recording paper sensor S, that the thickness and the stiffness of the recording paper P are slightly lower than the predetermined range, there is a fear that the separation from the toner image receiving member 14*a* is not possible without the separating action of the paper separating AC discharger 14*h*. However, when alternatively, the control section determines that separability from the toner image receiving member 14*a* is likely to be good with the separating action of the paper separating AC discharger 14*h* and it is possible to convey the separated recording paper P smoothly in a flat posture, and there is no need to fear that the toner image on the rear surface will be disturbed by the spur wheels 162, etc. (for example, when the recording paper P in a range of 40 g/m2–60 g/m2 is utilized), the control section sets the system so that the recording paper P, having the transferred toner images on both its sides, receives the discharging action of the paper separating AC discharger 14*h* and is separated from the toner image receiving member 14*a* by the curvature of the driving roller 14*d* and/or the exfoliating action of the separating claw 161. The separated recording paper P is subsequently conveyed to the fixing unit 17 without scattering of the toner image of the rear surface, as shown in FIG. 5.

When the control section determines that the thickness and the stiffness of the recording paper P are considerably lower than the predetermined range so that it is likely to be difficult to maintain a flat conveyance posture for fear that the recording paper P will hang down midway in the transporting path and, hence, the toner image on the rear surface would be disturbed by the spur wheels 162, etc. (for example, when the recording paper P in a range of 30 g/m2–40 g/m2 is utilized), the control section changes the double-sided image forming mode to the single-sided image forming mode to perform only a front surface image formation. In this case, the control section sets the system to apply the discharge operation of the paper separating AC discharger 14*h* for poor separability of the recording paper P.

Further, when the control section determines that the thickness and the stiffness of the recording paper P are excessively lower than the predetermined range so that it will be troublesome to separate the recording paper P form the toner image receiving member 14*a*, as well as troublesome conveying and fixing due to its thinness and weakness (for example, when the recording paper having less than 30 g/m2 is utilized), the image formation is banned as a whole, displaying "copy impossible" on the display section located on the operating panel.

The controlling functions as described above, which are conducted by the control section based on the thickness and the stiffness detected by the recording paper sensor S, are summarized in the following Table 1. As shown in the Table 1, according to the present invention, it becomes possible to offer a double-sided image forming apparatus which always yields high quality images by conducting optimum control in accordance with the recording paper currently utilized, irrespective of the parameters of the recording paper.

TABLE 1

| Detected Thickness-Stiffness | Paper Separating AC-Discharger 14h | Image Forming Mode |
|---|---|---|
| Large | OFF | Ban |
| ↑ | OFF | Enable front surface |
| \| | OFF | Enable double side |
| Standard | ON | Enable double side |
| \| | ON | Enable front surface |
| ↓ | | |
| Small | OFF | Ban |

Although, in the above description, an embodiment which selects the image forming mode and controls the discharging conditions on the basis of the thickness and the stiffness detected by the recording paper sensor S, it is also possible to discriminate the sort of the recording paper P by selecting either the paper feeding cassette 15 or the manual paper feeding plate 30A, or by an incoming signal from the operating section, having been inputted by an operator by selecting keys such as a thick paper mode, a thin paper mode, etc.

The abovementioned embodiment comprises the following elements and steps:

after once transferring the rear surface toner image, formed on the photoreceptor drum 10, as the first image bearing element, onto the toner image receiving member 14*a*, as the second image bearing member, the front surface toner image is successively formed on the photoreceptor drum 10; and the toner images on the photoreceptor drum 10 and the toner image receiving member 14*a* are transferred to the both surfaces of the sheet-shaped medium, respectively.

In addition to the above, an embodiment, comprised of the following elements and steps, is also included in the scope of the present invention:

a photoreceptor drum (herein after referred to as the photoreceptor drum 10A), as a first image bearing member, which forms a rear surface image and another photoreceptor drum (herein after referred to as the photoreceptor drum 10B) which forms a front surface image, are provided separately in the apparatus;

after transferring the rear surface toner image formed on the photoreceptor drum 10A to a second image bearing member by means of a first transferring means, a sheet-shaped medium is fed to a position between the photoreceptor drum 10B and the second image bearing member;

a front surface image formed on the photoreceptor drum 10B is transferred to the front surface of the sheet-shaped medium by means of a second transferring means; and the rear surface image formed on the second image bearing member is also transferred to the rear surface of the sheet-shaped medium by means of a third transferring means.

According to the present invention, it becomes possible to provide the double-sided image forming apparatus which conducts the discharging operation, after toner image transfer, and image formation of the front and the rear surfaces by selecting an optimum mode in response to the thickness and the quality of the incoming sheet-shaped medium. As a result, the discharging operation, which is also necessary for a relatively thick or thin sheet-shaped medium being out of the predetermined range, is optimally carried out, and it becomes possible to form only images which is insurable at least in terms of image quality.

What is claimed is:

1. A double-sided image forming apparatus, which forms images on both surfaces of a sheet-shaped medium, comprising:

a first image bearing element to bear a toner image;

a second image bearing element, mounted opposite said first image bearing element, to bear a toner image;

a first transfer means for transferring said toner image to a first surface of said sheet-shaped medium from said first image bearing element;

a second transfer means for transferring said toner image to a second surface of said sheet-shaped medium from said second image bearing element;

a fixing means for fixing said toner images transferred to said sheet-shaped medium, wherein said sheet-shaped medium is conveyed to said fixing means by said second image bearing element, after said first transfer means transfers said toner image to the first surface of said sheet-shaped medium, and said second image bearing element includes a separating section with a curved shape, located at an end portion of it toward said fixing means, to separate said sheet-shaped medium from said second image bearing element by means of a curvature of said separating section;

a discharger, disposed opposite to said second image bearing element, to discharge electric charges residing on said sheet-shaped medium, after said toner image is transferred onto said second surface of said sheet-shaped medium;

a detector to detect thickness and/or stiffness data of said sheet-shaped medium; and a controller to control a first image forming mode, which enables to form images on both surfaces of said sheet-shaped medium by means of both said first image bearing element and said second image bearing element, and to control a second image forming mode, which enables to form an image on only a single surface of said sheet-shaped medium by means of said first image bearing element, wherein said controller controls said discharging operation of said discharger, said first image forming mode and said second image forming mode, on the basis of the data detected by said detector.

2. The double-sided image forming apparatus of claim 1, wherein said controller enables said first image forming mode, and performs said discharging operation of said discharger, when said data, detected by said detector, result in a first range.

3. The double-sided image forming apparatus of claim 2, wherein said controller enables said first image forming mode without performing said discharging operation of said discharger, when said data, detected by said detector, result in a second range while exceeding said first range.

4. The double-sided image forming apparatus of claim 3, wherein said controller disable said first image forming mode, when said data, detected by said detector, result in a third range while exceeding said second range.

5. The double-sided image forming apparatus of claim 4, wherein said controller bans image forming operations as a whole, when said data, detected by said detector, result in a forth range while exceeding said third range.

6. The double-sided image forming apparatus of claim 2, wherein said controller disable said first image forming mode, when said data, detect ed by said detector, result in a fifth range which is lower than said first range .

7. The double-sided image forming apparatus of claim 6, wherein said controller bans image forming operations as a whole, when said data, detected by said detector, result in a sixth range which is lower than said fifth range.

8. The double-sided image forming apparatus of claim 1, wherein said sheet-shaped medium is conveyed from said second image bearing element to said fixing means in such a manner that said sheet-shaped medium is puckered upward, forming a loop between them.

9. The double-sided image forming apparatus of claim 1, further comprising:

a conveyance section disposed at a position between said second image bearing element and said fixing means.

10. The double-sided image forming apparatus of claim 9, wherein said conveyance section includes a single spur wheel or a plurality of spur wheels disposed upper side of said conveyance section.

11. The double-sided image forming apparatus of claim 1, further comprising:

a separating claw disposed opposite said second image bearing element in the vicinity of said separating section.

12. The double-sided image forming apparatus of claim 1, where in said toner image is formed on said first image bearing element and/or said second image bearing element by means of a common image forming means.

13. The double-sided image forming apparatus of claim 12, wherein said common image forming means includes a charging means, an image exposing means and a developing means.

* * * * *